United States Patent [19]

Yogo et al.

[11] Patent Number: 4,938,047

[45] Date of Patent: Jul. 3, 1990

[54] BENDING MACHINE

[75] Inventors: Teruaki Yogo, Aichi; Junsuke Inoue, Seto, both of Japan

[73] Assignee: Kabushikikaisha Chuodenkiseisakusho, Aichi, Japan

[21] Appl. No.: 433,095

[22] Filed: Nov. 8, 1989

[30] Foreign Application Priority Data

Nov. 24, 1988 [JP] Japan ..... 63-296988

[51] Int. Cl.[5] ..... B21D 7/04

[52] U.S. Cl. ..... 72/149

[58] Field of Search ..... 72/149, 150, 153, 154, 72/155, 156, 157, 158, 159, 320, 321

[56] References Cited

U.S. PATENT DOCUMENTS

| | | | |
|---|---|---|---|
| 4,063,441 | 12/1977 | Eaton | 72/151 |
| 4,178,788 | 12/1979 | Zollweg et al. | 72/154 |
| 4,201,073 | 5/1980 | Eaton | 72/155 |
| 4,552,006 | 11/1985 | Yogo | 72/149 |
| 4,750,346 | 6/1988 | Traub | 72/149 |
| 4,760,726 | 8/1988 | Traub | 72/149 |

FOREIGN PATENT DOCUMENTS

| | | | |
|---|---|---|---|
| 314226 | 9/1919 | Fed. Rep. of Germany | 72/149 |
| 2642942 | 3/1978 | Fed. Rep. of Germany | 72/149 |
| 627885 | 10/1978 | U.S.S.R. | 72/149 |
| 987148 | 3/1965 | United Kingdom | 72/149 |

*Primary Examiner*—E. Michael Combs

*Attorney, Agent, or Firm*—Pollock, Vande Sande & Priddy

[57] ABSTRACT

A bend arm is mounted on a base frame for turning movement. The bend arm is provided with a bend die and a work is clamped to the bend die by a clamp die. A drive arm is also mounted on the base frame for turning movement and is connected to the bend arm by a link. The bend arm is turned by the turn of the drive arm via the link and the work is bent by the turn of the bend arm on the model of the bend die. The distance from the center of turn of the drive arm to the connection point of the link to the drive arm is longer than that from the center of turn of the bend arm to the connection point of the link to the bend arm. Furthermore, the former distance is longer than the distance from the center of turn of the bend arm to the center of turn of the drive arm. Thus, the bend arm can be turned beyond 180° by the turn of the drive arm by an angle less than 180°.

5 Claims, 4 Drawing Sheets

BENDING MACHINE

BACKGROUND OF THE INVENTION

1. Field of the Invention

This invention relates to a bending machine for preforming bending process on a long work such as a pipe or a bar at various places along the longitudinal direction of the work.

2. Description of the Prior Art

Among conventional bending machines, there is one having the following structure. That is, the bending machine comprises a bend arm mounted on a base frame for turning movement, a bend die disposed coaxially with the center axis of turn of the bending arm and a clamp die provided on the bend arm in order to clamp the work to the bend die. In this machine, the bend arm is pushed, at a point thereof off the center axis of turn, by a drive mechanism and is turned relative to the base frame. The work is bent on the model of the bend die by the turn of the bend arm. The bending machine of this type is exemplified by U.S. Pat. No. 4,552,006.

It is a feature of the bending machine having the bend arm thereof pushed by the drive mechanism that the machine can perform appropriate bending processes on the long work at various places one after another along the longitudinal direction of the work even though spacing between places to be processed is small. This point is explained in details. The bending process is first performed on the work at a first place. Then the work is shifted forwards and a second place of it is positioned between the bend die and the clamp die. In this case, in order to make the direction of bending at the second place be different from that at the first place, for example, by 90°, the work is turned by 90° about the center axis of that portion of the work which is not yet processed, i.e., positioned in the backward of the bend die. As the result of this turn of the work, the portion of the work in the forward of the already bent first place is pendant in front of the bend arm. In this situation, the bending process is performed at the second place.

When the bending process is performed in the above mentioned manner, the bending machine having its bend arm pushed by the drive mechanism leaves such a large space in the forward of the bend arm as extending up to a position close by the bend die. Accordingly, even though the first place is close by the second place, the portion of the work in the forward of the first place can be hung in front of the bend arm without any hindrance. Consequently, even though the spacing between places to be processed is small, the bending process can be appropriately performed.

On the other hand, when the work is to be bent by 180°, it has to be turned by an angle larger than 180° since the work has a tendency to spring back. In this case, it is impossible to turn the bend arm by an angle larger then 180° by pushing it by a linearly expanding and contracting drive means such as a hydraulic cylinder since there appears than a dead point in the turning movement of the bend arm. For this reason, it is necessary to use, as a drive mechanism for the bend arm, a special drive apparatus, i.e., one comprising a pair of cranks provided separately from each other and adapted to be synchronously turned and a drive link with the forward end thereof connected to the bend arm and the intermediate portion and the backward end thereof connected to the respective cranks. The drive mechanism of this type, however, occupies a large area.

Accordingly, it occupies a large space within the base frame and restricts the installation of other various mechanisms to be provided on the base frame.

SUMMARY OF THE INVENTION

A first object of the present invention is to provide a bending machine wherein bending process can be performed on a long work at various places one after another along the longitudinal direction of the work.

A second object of the present invention is to provide a bending machine wherein an appropriate bending process can be performed on the work even through the spacing between portions to be processed is small.

A thrid object of the present invention is to provide a bending machine wherein a bend arm can be turned by an angle larger than 180° only by turning a drive arm by an angle smaller than 180°.

According to the present invention, on a base frame are mounted a bend arm and a drive arm for turning movement about a first axis and a second axis, respectively. One end of a link is pivotally connected to the bend arm and the other end to the drive arm. When the position of the first axis is represented by 01, the position of the second axis by 02, the pivot point of the link on the bend arm by A and the pivot point of the link on the drive arm by B, the relationship among distances 01·A, 02·B and 01·02 among the positions and points satisfies inequalities $$01 \cdot A < 02 \cdot B \text{ and}$$

$$01 \cdot 02 < 02 \cdot B.$$

Accordingly, the bend arm can be turned by an angle larger than 180° only by turing the drive arm by an angle smaller then 180°.

If the turn angle of the drive arm smaller than 180° is sufficient, it is possible to actuate the drive arm by a linearly expanding and contracting drive means such as a hydraulic cylinder. This is because there is not any dead point then in the tuning movement of the drive arm. The linearly expanding and contracting drive means such as a hydraulic cylinder occupies only a small area. As a result, the linearly expanding and contracting drive means can be arranged close by the bend arm and interferes little with the other various mechanisms provided on the base frame.

DESCRIPTION OF THE PREFERRED EMBODIMENTS

Figure 1:
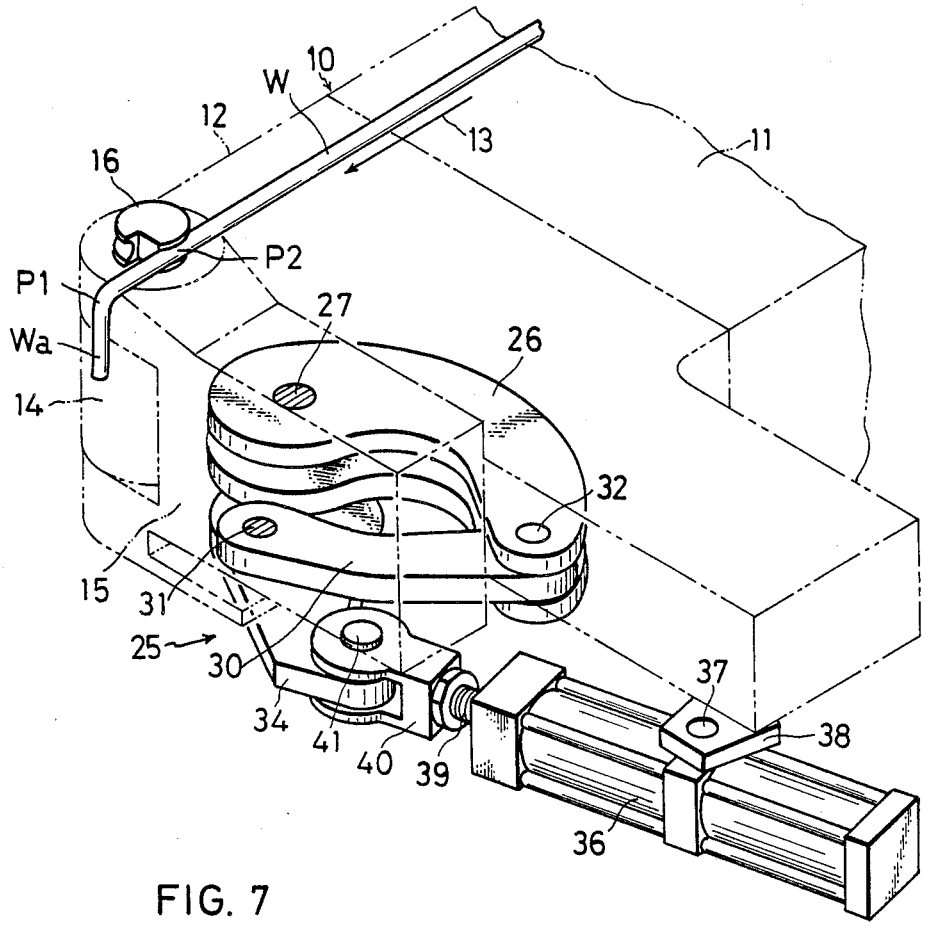
FIG. 1 is a perspective view showing a drive mechanism for a bend arm provided at the head portion of a bending machine.
Figure 2:
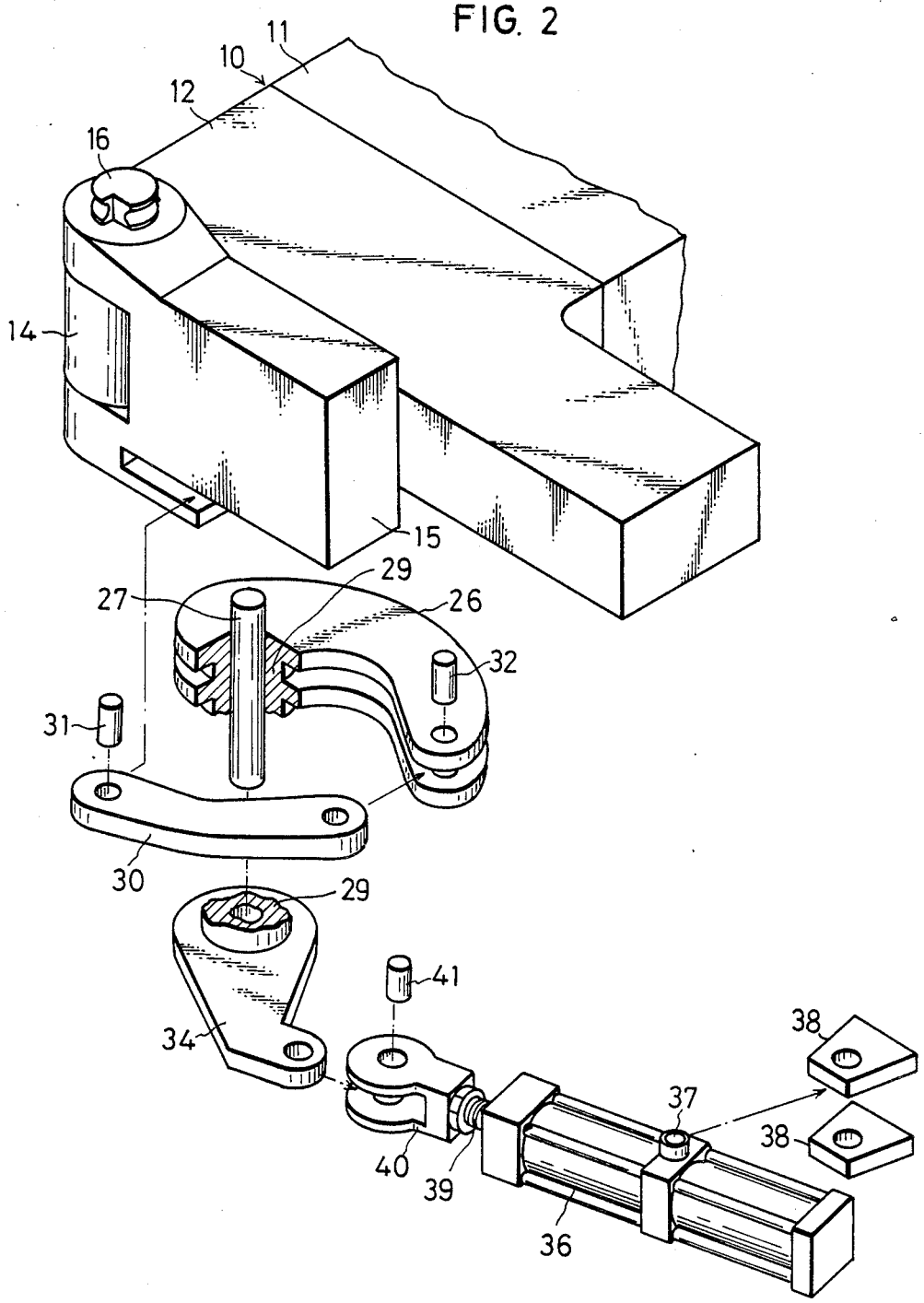
FIG. 2 is a fragmentary perspective view showing various components of the drive mechanism.
Figure 4:
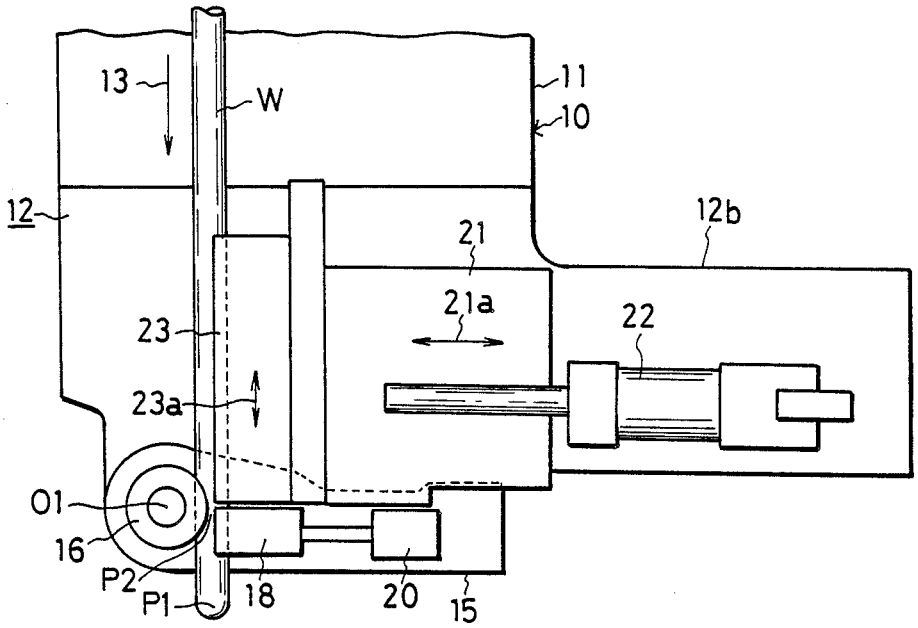
FIG. 4 is a plane view of the head portion of the bending machine.

In FIGS. 1, 2 and 4, a base frame 10 comprises a body frame 11 and a support frame 12. The body frame 11 is made in a form elongated in the up and down direction in FIG. 4 and on the forward end thereof is mounted the support frame 12. A work W is supplied by a well known carriage (not shown) provided on the body frame 11 in the supply direction shown by an arrow 13 in FIG. 4. A pipe or a bar can be the work W and the cross section of the work may be circular or rectangular. In the present specification, the side toward which the work is supplied (the downward side in FIG. 4) is referred to as the forward and the opposite side as the backward. The support frame 12 comprises a vertical portion 12*a* attached to the forward surface of the body frame 11 and a horizontal portion 12*b* integral with the vertical portion 12*a*. The horizontal portion 12*b* has a support portion 14 protruding in the direction shown by the arrow 13. A bend arm 15 is mounted on the support portion 14 for turning movement about a first vertical axis 01. A bend die 16 is mounted on the bend arm 15 in coaxial relationship with the first axis 01 and besides for dismount for exchange. The bend die 16 is formed with a groove 17 in which the work W fits. A clamp die 18 to clamp the work W to the bend die 16 is mounted on the bend arm 15 for movement in the longitudinal direction of the bend arm 15. The clamp die 18 is adapted to be transferred toward and away from the bend die 16 by a hydraulic cylinder 20. The clamp die 18 is formed, at the side thereof facing the bend die 16, with a groove 19 in which the work W fits. On the support frame 12 is provided a die bolster 21 for movement in the direction shown by an arrow 21*a* by means of a hydraulic cylinder 22. A pressure die 23 is held by the die bolster 21 for transfer in the direction shown by an arrow 23*a*. The pressure die 23 is for preventing the work W from separating from the bend die 16 while bending process is performed on the work W.

Figure 3:
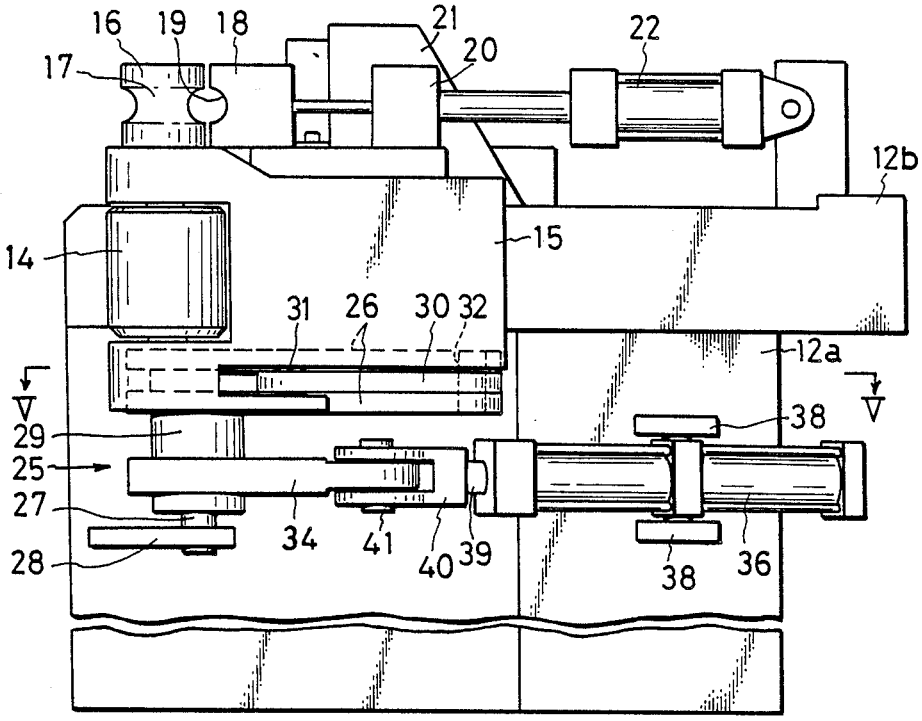
FIG. 3 is a front elevation of the head portion of the bending machine.
Figure 5:
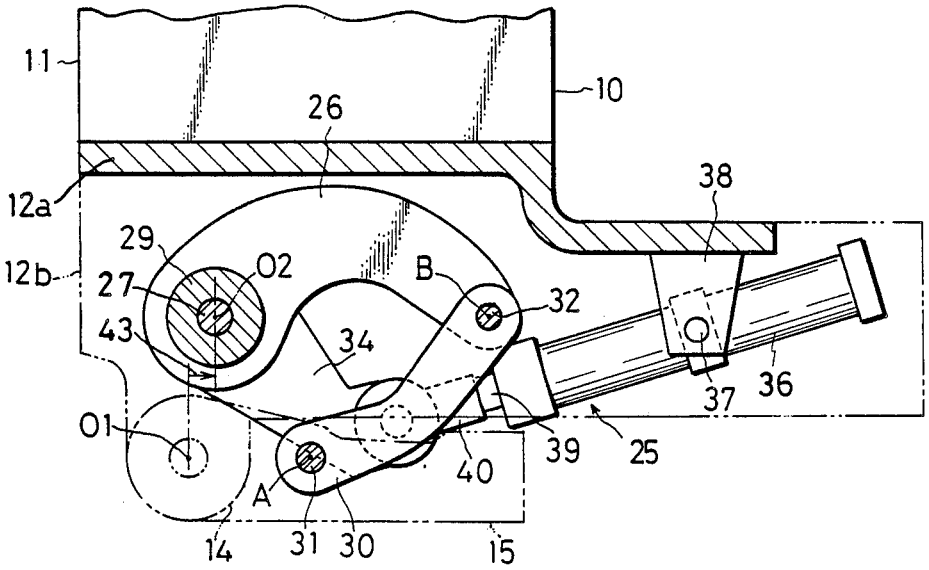
FIG. 5 is a horizontal section taken along a line V—V in FIG. 3.
Figure 6:
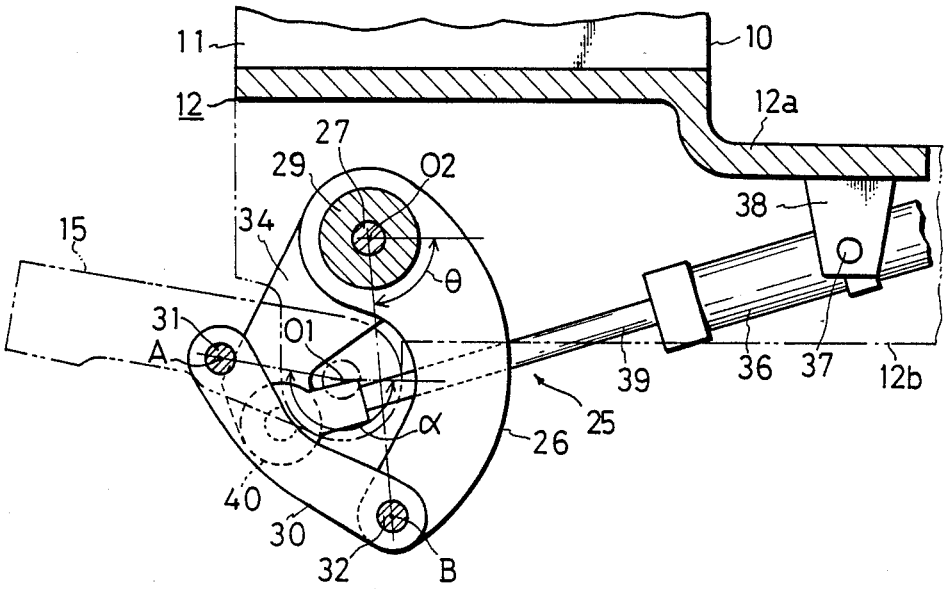
FIG. 6 is a horizontal section for showing the state of operation of the drive mechanism.

In the next place, a drive mechanism 25 for turning the bend arm 15 about the above mentioned first axis is explained. As shown in FIG. 5, a drive arm 26 is mounted on the support frame 12, for turning movement about a second vertical axis 02 in the backward of the first vertical axis 01. Namely, a support shaft 27 is secured, at the top end thereof, to the horizontal portion 12*b* of the support frame 12 and is secured, at the bottom end thereof, to the vertical portion 12*a* by means of a fastening piece 28 as shown in FIG. 3. A boss 29 formed at the basal portion of the drive arm 26 is turnably fit on the support axis 27. The bend arm 15 and the drive arm 26 are connected by a link 30. The link 30 is pivotally connected, at one end thereof, to the bend arm 15 by a pin 31 and at the other end thereof, to the free end portion of the drive arm 26 by a pin 32. As shown in FIGS. 5 and 6, if the pivot point of the link 30 on the bend arm 15, i.e., the center axis of the pin 31 is represented by a character A and the pivot point of the link 30 on the drive arm 26, i.e., the center axis of the pin 32 by a character B, then the distances 01·A, 02·B, 01·02 and A·B among the first axis 01, the second axis 02, the pivot point A and the pivot point B are, in the present embodiment, 01·02=255 mm, 01·A=220 mm, 02·B=490 mm and A·B=406 mm and satisfy inequalities $$01{\cdot}A < 01{\cdot}02 < A{\cdot}B < 02{\cdot}B.$$

The spacing, in the supply direction of the work W, between the first axis 01 and the second axis 02 is 250 mm and the spacing, in the direction perpendicular to the supply direction of the work W, between them is 50 mm. In the situation where the bend arm 15 is in a standard position shown in FIGS. 4 and 5, the point A is positioned just beside the first axis 01 and the point B just beside the second axis 02.

When the drive arm 26, in the sturcture as mentioned, is turned about the second axis 02 in the clockwise direction in FIG. 5, the bend arm 15 is pushed by the link 30 to be turned about the first axis 01 similarly in the clockwise direction. In this case, since the above mentioned inequalities 01·A<02·B and 01·02<02·B hold, the turn angle $\alpha$ of the bend arm 15 is much larger than the turn angle $\theta$ of the drive arm 26 as shown in FIG. 6. In the present embodiment, the bend arm 15 is turned by 190° as the drive arm 26 is turned by 86° as shown in FIG. 6. The drive arm 26 and the link 30 are both made in a bent form and are adapted not to interfere with the support portion 14 in the support frame 12 and the basal portion of the bend arm 15 even when the drive arm 26 is turned to the position shown in FIG. 6.

The structure for turning the drive arm 26 is now explained. The basal portion of a driven arm 34 is connected integrally with the bottom end of the boss 29 in the drive arm 26. As an example of the linearly expanding and contracting drive means for actuating the driven arm 34, an oil hydraulic cylinder 36 is shown. The oil hydraulic cylinder 36 is provided, at the intermediate portion thereof, with a pin 37 and is supported, for oscillating movement in a horizontal plane, by a pair of support pieces 38 attached to the vertical portion 12*a* in the support frame 12. A connection fitting 40 is attached to an extreme end of a piston rod 39 in the oil hydraulic cylinder 36 and is connected to an extreme end of the drive arm 34 by a pin 41. As the oil hydraulic cylinder 36, a trunnion-type oil hydraulic cylinder is used for example. Furthermore, as the linearly expanding and contracting drive means, an air cylinder or an electromagnet operated plunger may be used instead of the oil hydraulic cylinder. The length of the driven arm 34 and the stroke and thrust of the oil hydraulic cylinder 36 are determined in accordance with the bending torque and turn angle necessary for the bend arm 15.

Next, the bending process performed by the above mentioned bending machine on the work W is explained. When the bending arm 15 is at the standard position shown in FIGS. 4 and 5, the work W is supplied in the direction shown by the arrow 13 and a first place to be processed is positioned between the bend die 16 and the clamp die 18. Then this place is clamped to the bend die 16 by the clamp die 18. Next, when pressure oil is supplied to the oil hydraulic cylinder 36 and the piston rod 39 expands, the drive arm 26 is turned via the driven arm 34 in the clockwise direction in FIG. 5. As a result, the bend arm 15 is turned in the clockwise direction as mentioned above. The bend die 16 and the clamp die 18 both on the bend arm 15, with the work W sandwiched therebetween, is turned about the first axis 01 and the work W is bent on the model of the bend die 16. The bend arm 15 is turned up to an angle which can give the work W a prescribed bend angle (an angle taking the spring back of the work W into account). The turn angle of the bend arm 15 can be detected by a well known rotation angle detecting encoder connected to the bend arm 15. Next, the clamping of the work W by the clamp die 18 is released and the bend arm 15 is returned by the contraction of the piston rod 39 to the original position in FIG. 5. Thus the bending process at the first place is completed.

Furthermore, the bending process on the work W at a second place is performed in the following manner.

Here, the case is explained where the direction of bending at the second place is different from that at the first place. The first and second places are represented, in FIGS. 1 and 4, by characters P1 and P2 respectively. The work W is supplied in the direction shown by the arrow 13 and the second place P2 is positioned between the bend die 16 and the clamp die 18. Next, the work W is turned about the center axis of the unprocessed portion thereof. As a result, a portion Wa of the work W in the forward of the already bent first place P1 is, for example, pendant in front of the bent arm 15. In this case, a large space in the forward of the bend arm 15 is empty up to position just close by the bend die 16. Accordingly, even though the spacing between the first place P1 and the second place P2 is small, the above mentioned portion Wa can be positioned in front of the bend arm 15 without hindrance. Then the same operation as in the bending process at the first place is performed and the bending process at the second place is completed.

Operations of the type as mentioned above are repeated one after another and the bending process is performed at various places of the work W.

The distance between the pivot points A and B, the length of the link 30 in other words, may be larger than the distance between the second axis 02 and the pivot point B.

Modified examples of several portions are now explained. The bend die 16 may be mounted on the support frame 12 for turing movement about the first axis 01. Also in the case, the work W is bent by the turn of the bend arm 15 in the same manner as in the previous case. On the other hand, the bend die 16 may be fixedly mounted on the support frame 12 in coaxial relationship with the first axis 01. In this case, the clamp die 18 revolves about the bend die 16 as the result of the turn of the bend arm 15. Consequently, the work W is bent at forward portions one after another while the work is pressed against the bent die 16 by the clamp die 18. Also as another example, a bend die formed with two grooves of different radii and aligned vertically and a clamp die formed with corresponding grooves aligned vertically may be adopted.

Figure 7:
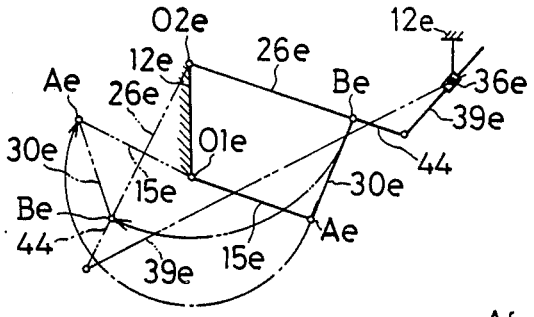
FIGS. 7 and 8 are schematic views showing different embodiments of the drive mechanism.

Next, a different embodiment of the drive mechanism is shown in FIG. 7. In the embodiment shown in FIGS. 1 through 6, the second axis 02 is slightly deviated from first axis 01 in the direction transverse to the supply direction of the work as shown by a numeral 43 in FIG. 5. In this embodiment, however, the first axis 01 and the second axis 02 are aligned on the supply direction of the work. Furthermore, the relationship among the distances 01*e*·Ae, 02*e*·Be, 01*e*·02*e* and Ae·Be among a first axis 01*e*, a second axis 02*e* and pivot points Ae and Be is adjusted to satisfy inequalities $$Ae \cdot Be < 01e\#02e < 01e \cdot Ae < 02e \cdot Be.$$

Besides, the structure for turning a drive arm 26*e* comprises an extended portion 44 formed by extending the extreme end of the drive arm 26*e* and an oil hydraulic cylinder 36*e* with a piston rod 39*e* thereof connected to the extended portion 44.

Also in the drive mechanism constructed in this manner, a bend arm 15*e* can be turned by an angle exceeding 180° only by turning the drive arm 26*e* by an angle less than 180° by the oil hydraulic cylinder 36*e*.

Those components in the present figure which can be considered functionally same as or equivalent to the components in the previous figures are given numerals and characters same as in the previous figures but with an alphabet e and repeated explanations are omitted. (As for the components in the following figure, an alpohabet f is attached to reference numerals and characters in accordance with the same idea and repeated explanations are again omitted.)

Figure 8:
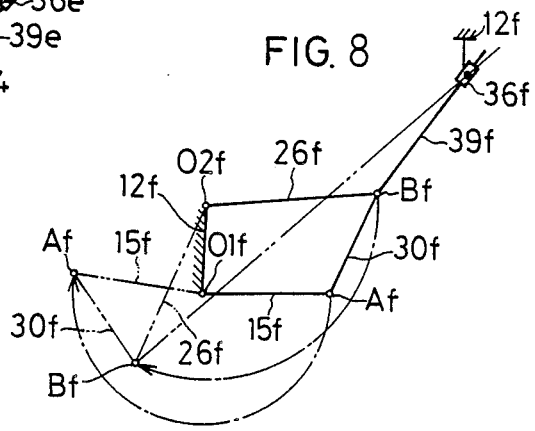

Next, in FIG. 8, a still different embodiment of the drive mechanism is shown. In this embodiment, the relationship among the distances 01*f*·02*f*, Af·Bf, 01*f*·Af and 02*f*·Bf among a first axis 01*f*, a second axis 02*f* and pivot points Af and Bf is adjusted to satisfy inequalities $$01f \cdot 02f < Af \cdot Bf < 01f \cdot Af < 02f \cdot Bf.$$

A piston rod 39*f* of an oil hydraulic cylinder 36*f* is adapted to push directly a drive arm 26*f* at the pivot piont Bf.

What is claimed is:

1. A bending machine comprising (a) a base frame, (b) a bend arm mounted on a forward end of said base frame for turning movement about a first pivot axis 01, (c) a bend die in coaxial relationship with said first pivot axis, (d) a clamp die mounted on said bend arm for movement toward and away from said bend die for to said bend die and (e) a drive mechanism connected to said bend arm for turning said bend arm about said first pivot axis, said drive mechanism including a drive arm mounted on siad base frame for turning movement about a second pivot axis 02 positioned rearwardly relative to said first pivot axis, an expanding and contracting drive means connected to said drive arm for turning said drive arm about said second pivot axis, and a link with one end thereof pivotally connected to said bend arm at a pivot point A spaced from said first pivot axis and with another end thereof pivotally connected to said drive arm at a pivot point B spaced from said second pivot axis, wherein a relationship among distances 01·A, 02·B and 01·02 between said first pivot axis 01, said second pivot axis 02, said pivot point A of said link on said bend arm and said pivot point B of said link on said drive arm satisfies the inequalities $$01 \cdot A < 02 \cdot B \text{ and}$$

$$01 \cdot 02 < 02 \cdot B.$$

2. A bending machine as set forth in claim 1 wherein said drive arm is angularly configured for avoiding interference of said drive arm with a basal portion of said bend arm.

3. A bending machine as set forth in claim 1 wherein the relationship among the distances 01·A, 01·02, A·B and 02·B define between said pivot axes 01, 02, and said pivot points A, B satisfies the further inequalities $$01 \cdot A < 01 \cdot 02 < A \cdot B < 02 \cdot B.$$

4. A bending machine as set forth in claim 1 wherein a relationship among distances Ae·Be, 01*e*·02*e*, 01*e*·Ae and 02*e*·Be defined between a first pivot axis 01*e*, a second pivot axis 02*e*, a pivot point Ae of said link on said bend arm and a pivot point Be of siad link on said drive arm satisfies the inequalities $$Ae \cdot Be < 01e \cdot 02e < 01e \cdot Ae < 02e \cdot Be.$$

5. A bending machine as set forth in claim 1 wherein a relationship among distances $01f \cdot 02f$, Af·Bf, $01f \cdot Af$ and $02f \cdot Bf$ defined between a first pivot axis 01/a second pivot axis $02f$, a pivot point Af of said link on said bend arm and a pivot point Bf of said link on said drive arm satisfies the inequalities $$01f \cdot 02f < Af \cdot Bf < 01f \cdot Af < 02f \cdot Bf.$$

* * * * *